US008783905B2

(12) United States Patent
Lai

(10) Patent No.: US 8,783,905 B2
(45) Date of Patent: Jul. 22, 2014

(54) HEAT-DISSIPATING MODULE AND LAMP HAVING THE SAME

(75) Inventor: Chyi-Lang Lai, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 451 days.

(21) Appl. No.: 13/082,400

(22) Filed: Apr. 8, 2011

(65) Prior Publication Data

US 2012/0257389 A1 Oct. 11, 2012

(51) Int. Cl.

| | |
|---|---|
| ***F21S 4/00*** | (2006.01) |
| ***F28F 7/00*** | (2006.01) |
| ***F21V 29/00*** | (2006.01) |
| ***F21S 8/02*** | (2006.01) |
| *F21Y 101/02* | (2006.01) |

(52) U.S. Cl.

CPC ..... *F21V 29/2231* (2013.01); *F21S 8/026* (2013.01); *F21V 29/2268* (2013.01); *F21Y 2101/02* (2013.01)

USPC ..... 362/249.02; 362/373

(58) Field of Classification Search

USPC ..... 313/45; 362/249.02, 373

See application file for complete search history.

(56) References Cited

U.S. PATENT DOCUMENTS

2010/0314983 A1* 12/2010 Chen ..... 313/45

* cited by examiner

*Primary Examiner* — Anh Mai
*Assistant Examiner* — Brenitra M Lee
(74) *Attorney, Agent, or Firm* — Chun-Ming Shih; HDLS IPR Services

(57) ABSTRACT

A heat-dissipating module includes a base plate and a plurality of fins. The base plate is made of sheet metal. The fins are formed by bending upwardly from the periphery of the base plate. Each of the fins has at least two bending sections. The region among the bending sections and the base plate is hollowed to form a plurality of airflow channels. By this structure, the airflow below the base plate can pass through the airflow channels to heat-exchange with the fins, thereby increasing the heat-dissipating effect. The present invention also relates to a lamp having the heat-dissipating module.

3 Claims, 5 Drawing Sheets

HEAT-DISSIPATING MODULE AND LAMP HAVING THE SAME

BACKGROUND OF THE INVENTION

1. Field of the Invention

The present invention relates to a heat-dissipating module and a lamp having the same. More particularly, the present invention relates to a heat-dissipating module having vertical airflow channels and a lamp having such a heat-dissipating module.

2. Description of Prior Art

With the advancement of science and technology, light emitting diodes (LED) are widely used in various lamps to replace traditional incandescent bulbs because the LEDs have low electricity consumption and long lifetime. However, each LED generates heat when emitting light. If the thus-generated heat is not dissipated to the outside, the heat will be accumulated in the LED to raise its temperature. As a result, electronic components in the LED will suffer damage or even burn down.

In order to solve the problem relating to the heat dissipation of the LEDs, the existing solution is to provide a heat-dissipating module made by aluminum extrusion. Such an aluminum-extruded heat-dissipating module includes a base and a plurality of fins integrally formed with the base. After the base of the heat-dissipating module is brought into thermal contact with the LEDs, the heat generated by the LEDs will be conducted to the base and then dissipated to the outside via the fins.

However, such a conventional heat-dissipating module has the following problems.

First, since the conventional heat-dissipating module is made by aluminum extrusion, a greater amount of aluminum material has to be used, which increases the weight of the heat-dissipating module.

Second, during the manufacturing process, the traditional aluminum-extruded heat-dissipating module is subjected to an extending step and a cutting step. As a result, the surface of the heat-dissipating module to be brought into thermal contact with a heat source is not flat sufficiently. Thus, heat-conducting paste is often applied to the surface to thereby increase the degree of adhesion and heat-conducting efficiency. However, the application of heat-conducting paste inevitably increases the working hours and production cost.

Third, in the conventional heat-dissipating module, the fins are integrally formed with the base by extrusion. Thus, airflow below the base cannot directly heat-exchange with the fins above the base because the air is blocked by the base. On the other hand, since light-emitting elements such as LEDs are usually mounted below the base, the heat generated by the light-emitting elements can be only conducted to the fins above the base by thermal conduction in metallic materials. Then, the heat conducted to the fins is dissipated by the airflow above the base. Therefore, the heat-dissipating effect is so limited.

Fourth, in the conventional aluminum-extruded heat-dissipating module, since the fins are extruded to form on the periphery of the base, the heat-dissipating rate in the central portion of the base is smaller than that in the peripheral portion of the base. Furthermore, the airflow above the base cannot pass through the fins at the peripheral portion of the base to flow over the central portion of the base. Thus, such an insufficient airflow has a poor effect on dissipating the heat in the central portion of the base. As a result, the heat accumulated in the central portion of the conventional heat-dissipating module cannot be dissipated easily. Accordingly, in consideration of the low heat-dissipating effect in the central portion of the base, the heat-generating light-emitting elements are usually arranged on the periphery of the base, which restricts the degree of freedom in arranging the light-emitting elements on the base.

Thus, it is an important issue for the present inventor to solve the above-mentioned problems.

SUMMARY OF THE INVENTION

The present invention is to provide a heat-dissipating module, which has a reduced working hours and production cost as well as an increased heat-dissipating effect.

The present invention provides a heat-dissipating module, including: a base plate made of sheet metal; and a plurality of fins formed by bending upwardly from a periphery of the base plate, each of the fins having at least two bending sections, a region among the bending sections and the base plate being hollowed to form a plurality of airflow channels.

The present invention is to provide a lamp having a heat-dissipating module. The heat-dissipating module has a reduced working hours and production cost as well as an increased heat-dissipating effect.

The present invention is to provide a lamp, including: a casing having a hollow chamber; a light-emitting assembly disposed in the hollow chamber; and a heat-dissipating module for dissipating heat generated by the light-emitting assembly, the heat-dissipating module comprising:

a base plate made of sheet metal and connected to the top of the casing; and a plurality of fins formed by bending upwardly from a periphery of the base plate, each of the fins having at least two bending sections, a region among the bending sections and the base plate being hollowed to form a plurality of airflow channels.

In comparison with prior art, the present invention has advantageous features as follows.

The base plate of the heat-dissipating module is made of sheet metal, for example, by stamping or pressing rather than by aluminum extrusion, so that the base plate made of a flat sheet metal can be easily pressed and bent to form the fins, thereby producing a three-dimensional heat-dissipating module with a reduced working hours and cost.

Since the heat-dissipating module of the present invention is made of sheet metal, the heat-dissipating module has a small thickness and light weight. Further, the base plate is formed by pressing sheet metal, which can increase the flatness of the base plate greatly. Thus, the base plate can be brought into flat contact with a heat source without using heat-conducting paste.

In the heat-dissipating module of the present invention, since the region among the bending sections and the base plate is hollowed to form a plurality of airflow channels, the airflow below the base plate can pass through the airflow channels easily to heat-exchange with the fins above the base plate. Thus, in addition to the airflow below the base plate, the air above the base plate also passes through the fins for heat exchange. In other words, the heat-dissipating module of the present invention utilizes the airflows below and above the base plate for heat dissipation, so that the heat-dissipating efficiency thereof is improved greatly.

Further, according to the present invention, the airflow above the base plate can pass through the fins to flow over the central portion of the base plate, and the heat accumulated in the central portion of the base plate can be dissipated easily, thereby allowing light-emitting elements to be arranged in the central portion of the base plate. Thus, the degree of freedom in arranging the light-emitting elements on the base plate is increased.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 5. The present invention provides a heat-dissipating module 130 and a lamp 100 having the heat-dissipating module 130.

Figure 1:
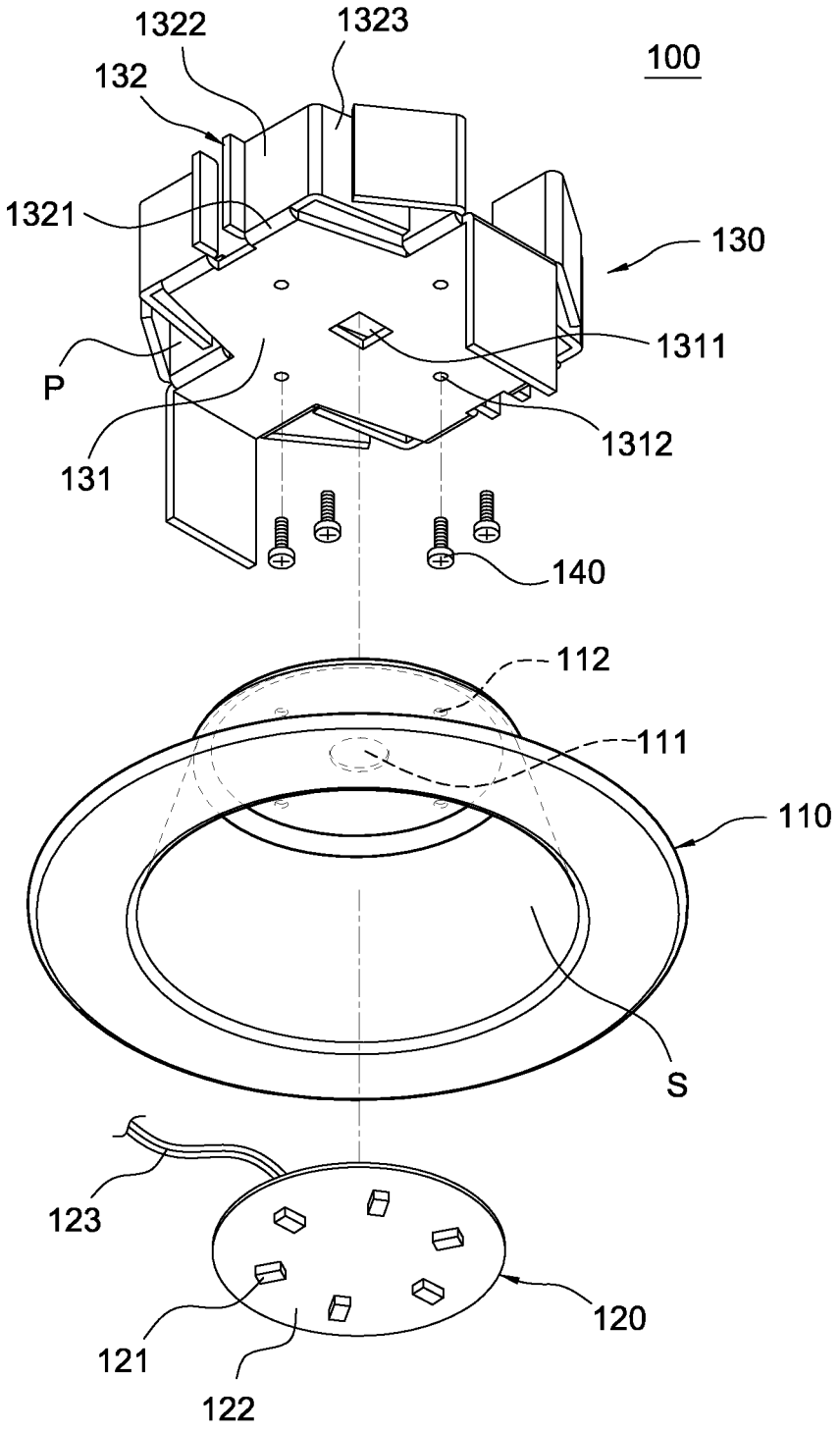
FIG. 1 is an exploded perspective view showing the lamp of the present invention.

As shown in FIG. 1, the lamp 100 of the present invention includes a casing 110, a light-emitting assembly 120 and the heat-dissipating module 130.

The casing 110 is made of metal material and has a hollow chamber S. The top surface of the casing 110 is provided with a wire-exiting hole 111 and a plurality of fixing holes 112. The light-emitting assembly 120 is provided in the hollow chamber S. The light-emitting assembly 120 includes a circuit board 121 and a plurality of LEDs 122 arranged on the circuit board 121. The circuit board 121 is electrically connected to a wire 123. One end of the wire 123 away from the circuit board 121 penetrates the wire-exiting hole 11 to connect to an external power source (not shown), thereby obtaining the necessary electricity of the lamp 100.

The heat-dissipating module 130 is used to dissipate the heat generated by the light-emitting assembly 130. The heat-dissipating module 130 comprises a base plate 131 and a plurality of fins 132.

The base plate 131 is made of sheet metal and connected to the top of the casing 110. More specifically, the central portion of the base plate 131 is provided with a through-hole 1311 for allowing one end of the wire 123 penetrating the wire-exiting hole 111 to pass through. The base plate 131 is further provided with a plurality of holes 1312 through which screws 140 are fixed into the fixing holes 112 of the casing 110, thereby fixing the base plate 131 to the casing 110.

Figure 2:
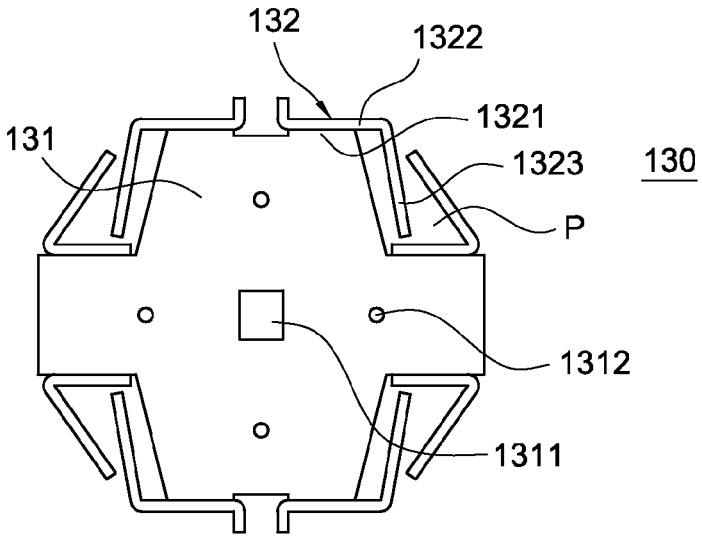
FIG. 2 is a top view showing the heat-dissipating module of the present invention.
Figure 3:
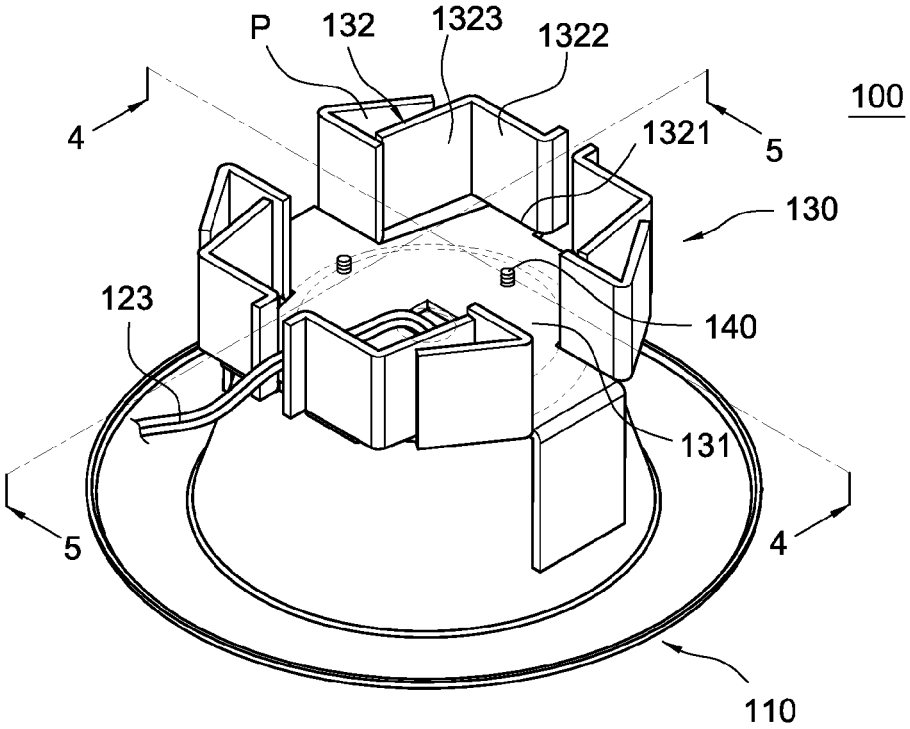
FIG. 3 is an assembled perspective view showing the lamp of the present invention.

As shown in FIGS. 2 and 3, the fins 132 are formed by bending upwardly from the periphery of the base plate 131. The reason why the fins 132 are bent upwardly lies in that the underside of the base plate 131 has to be mounted to the top of the casing 110, so that the fins 132 can be only bent above the base plate 131. More specifically, each of the fins 132 comprises a root 1321 connected to the periphery of the base plate 131, a first bending section 1322 and a second bending section 1323 both extending from the root 1321. The region among the first bending section 1322, the second bending section 1323 and the base plate 131 is hollowed to form a plurality of airflow channels P.

Figure 4:
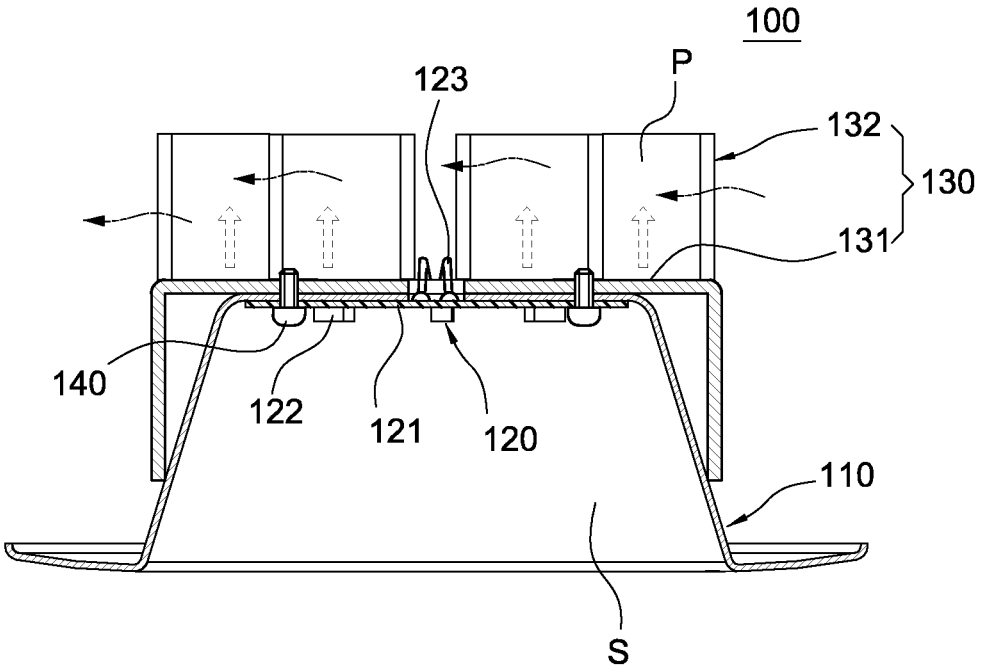
FIG. 4 is an assembled cross-sectional view of the lamp of the present invention taken along the line 4-4 of FIG. 3.

As shown in FIG. 3, the root 1321 means a portion connected between the base plate 131 and the first bending section 1312. In other words, the root 1321 is located on the periphery of the base plate 131. In the embodiment of FIG. 2, the base plate 131 is formed as a dodecagon and connected with eight fins 132. The roots 1321 of the eight fins 132 are located in some of the sides of the base plate 131. It should be noted that, the first bending section 1322 extends from the root 1321 to form a bending angle of about 90 degrees with respect to the base plate 131. The second bending section 1323 extends from the first bending section 1322 to form a bending angle of about 90 degrees. Most important of all, the second bending section 1323 is bent away from the periphery of the base plate 131 with respect to the first bending section 1322. By this structure, the airflow below the base plate 131 can pass through the airflow channels P and heat-exchange with the second bending section 1323 as shown in FIG. 4 without being blocked by the base plate 131. In this way, the heat-dissipating area of the base plate 131 is increased. On the other hand, the first bending section 1322 and the second bending section 1323 are bent in different directions, so that the airflow coming from different directions can contact these bending sections 1322 and 1323 respectively. Thus, the airflow coming from different directions can be used sufficiently for heat dissipation. The size and bending profiles of the first bending section 1322 and the bending sections 1323 can be changed based on practical demands, and are not limited to the specific forms shown in FIG. 3.

Figure 5:
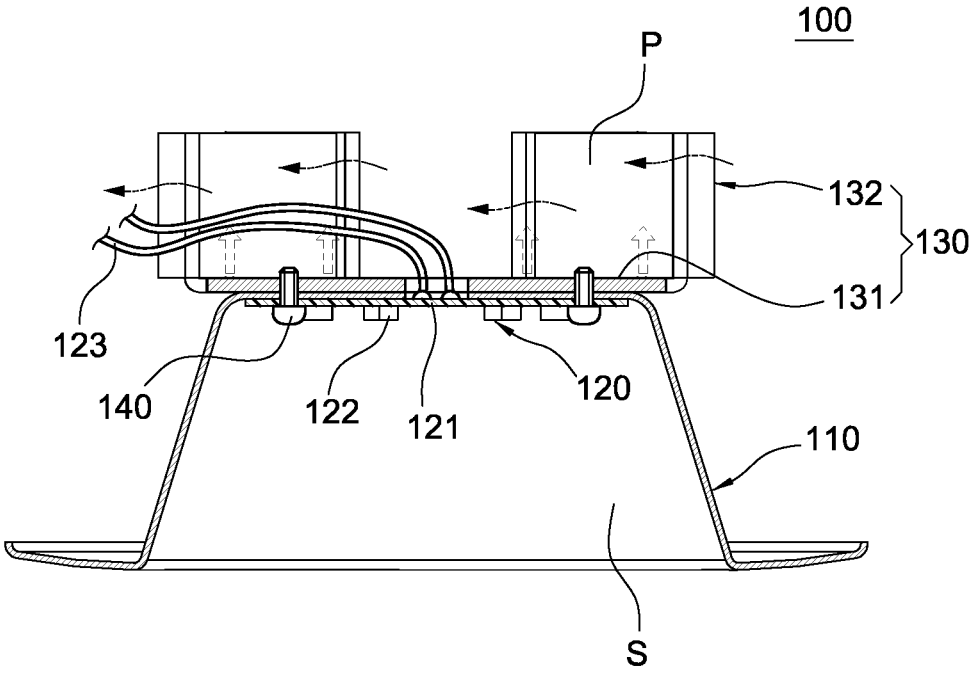
FIG. 5 is an assembled cross-sectional view of the lamp of the present invention taken along the line 5-5 of FIG. 3.

As shown in FIGS. 4 and 5, since the base plate 131 is made of sheet metal, it has a good flatness to be sufficiently adhered to the circuit board 121 of the light-emitting assembly 120, thereby generating good adhesion and heat conduction. Further, since the airflow above the base plate 131 can pass through the fins 132 to flow over the central portion of the base plate 131, the heat accumulated in the central portion of the base plate 131 can be dissipated by means of air convection.

Figure 6:
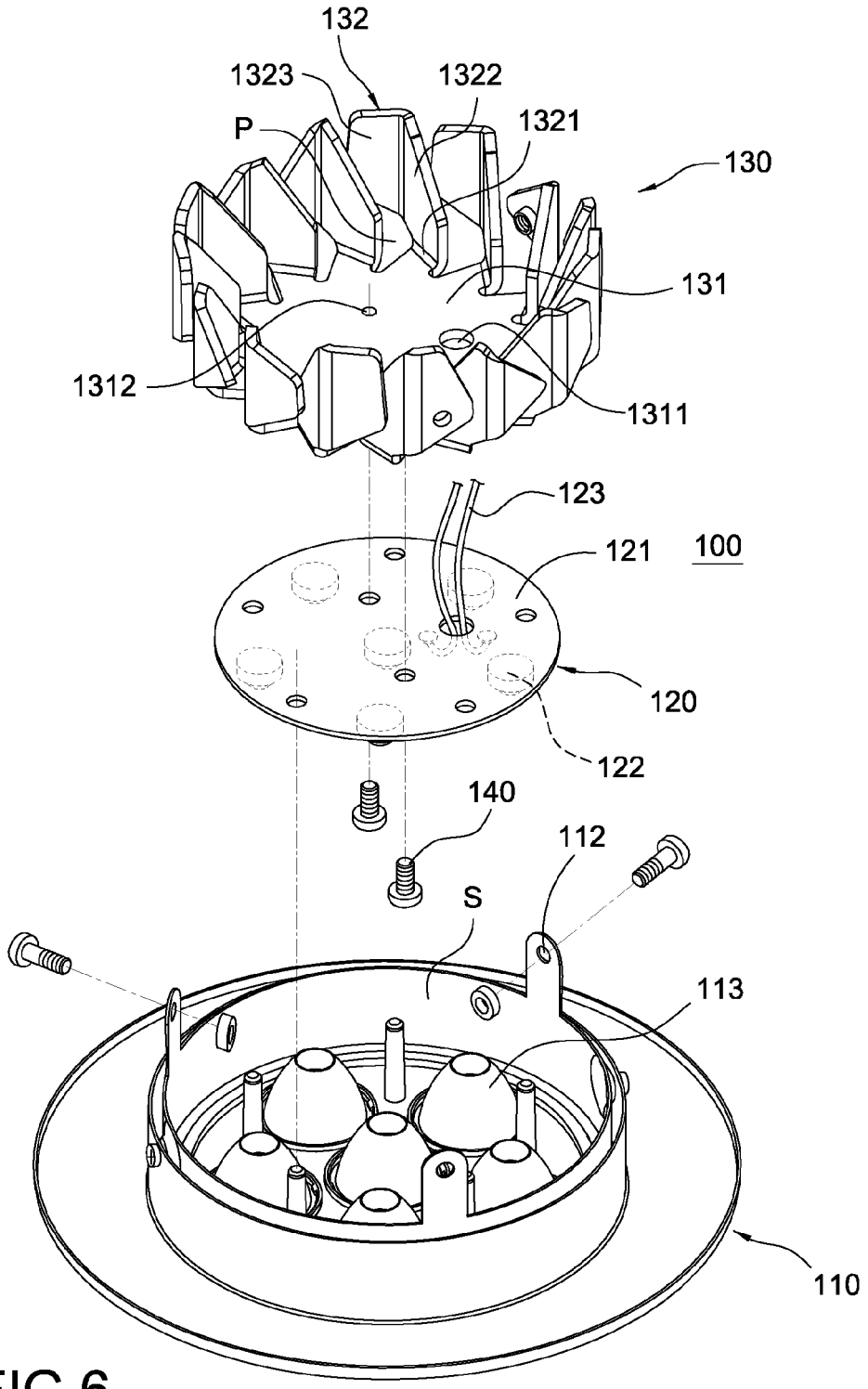
FIG. 6 is an exploded perspective view showing a second embodiment of the lamp of the present invention.
Figure 7:
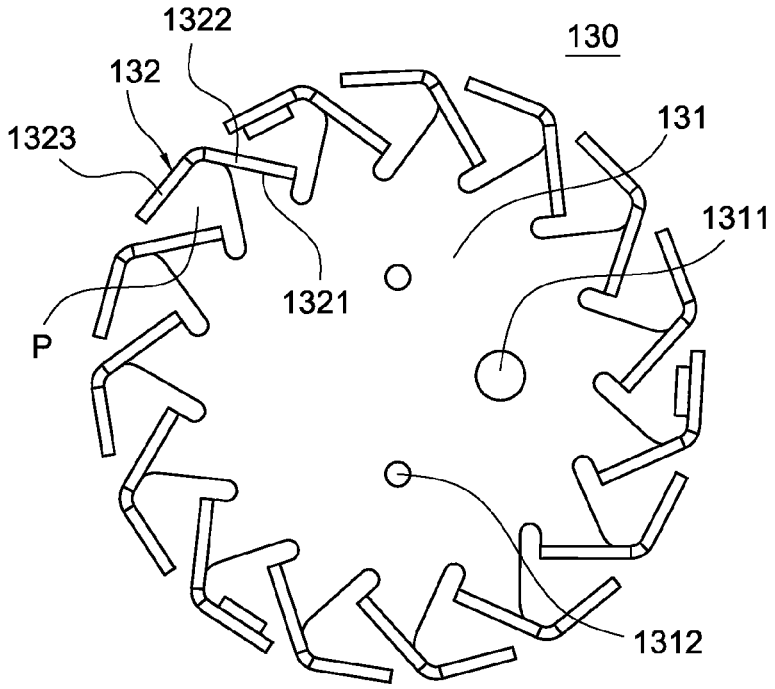
FIG. 7 is a top view showing a second embodiment of the heat-dissipating module of the present invention.
Figure 8:
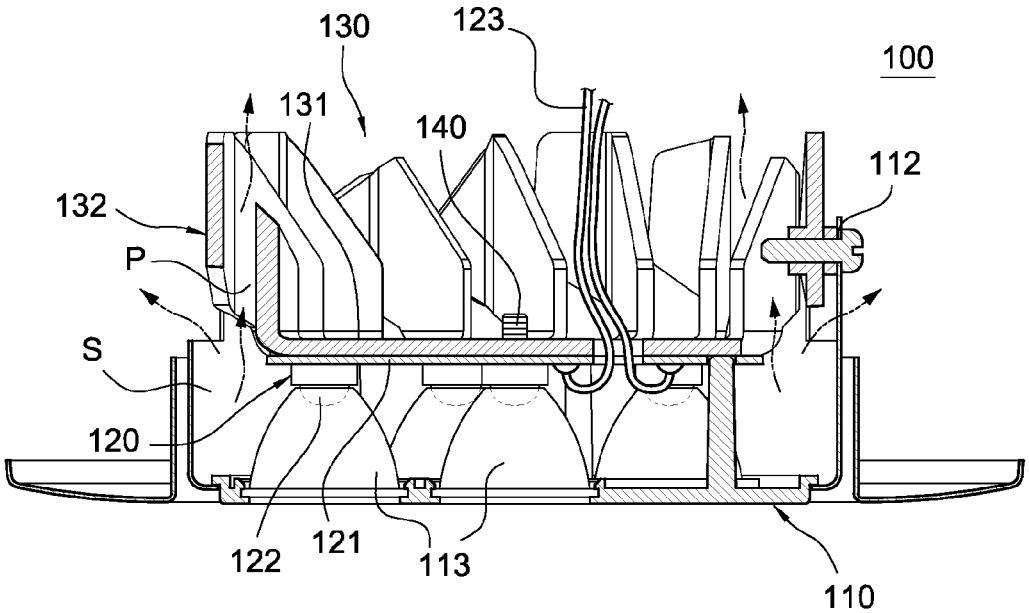
FIG. 8 is an assembled cross-sectional view showing the second embodiment of the lamp of the present invention.

Please refer to FIGS. 6 to 8, which show the second embodiment of the present invention. The difference between the second embodiment and the first embodiment lies in that: the casing 10 has different construction, while the base plate 131 and the fins 132 of the heat-dissipating module 130 have different profiles.

As shown in FIG. 6, the interior of the casing 110 has a hollow chamber S for allowing the light-emitting assembly 120 to be accommodated therein. The casing 110 of the second embodiment is formed in the hollow chamber S with a plurality of shrouds 114. Each of the shrouds 113 allows a LED 122 to be disposed therein, thereby increasing the degree of light collection of the respective LEDs 122. The circuit board 121 is provided in the hollow chamber S and located above the shrouds 113 in such a manner that, as shown in FIG. 8, it is brought into thermal contact with the lower surface of the base plate 121 of the heat-dissipating module 130. The periphery of the casing 110 is also provided with fixing holes 112 through which screws are used to fix the casing 110 to the heat-dissipating module 130.

It can be seen from FIG. 7 that, the periphery of the base plate 131 is shaped as a teethed wheel and has fifteen fins 132 provided on its periphery. The periphery of the base plate 131 is not a smooth curve but has some portions recessed into the periphery of the base plate 131, thereby causing the roots 1321 to further protrude from the periphery base plate 131. As shown in FIG. 6, the first bending section 1322 extends from the roots 1321 to form a bending angle of about 90 degrees with respect to the base plate 131. As shown in FIG. 7, the second bending section 1323 extends from the first bending section 1322 to form an acute bending angle with respect to the first bending section 1322. That is to say, the included angle between the first bending section 1322 and the second bending section 1323 is an obtuse angle. The second bending sections 1323 enclose a circular profile. In other words, each of the second bending sections 1323 is bent to be tangent to the center of the base plate 131. Further, the second bending section 1323 is bent away from the periphery of the base plate 131 with respect to the first bending section 1322. As a result, the airflow below the base plate 131 can pass through the airflow channels P to heat-exchange with the second bending section 1323 without being blocked by the base plate 131, thereby increasing the heat-dissipating area outside the base plate 131. On the other hand, the first bending section 1322 and the second bending section 1323 are bent in different directions, thereby contacting the airflow coming from different directions. Thus, the airflow coming from different directions can be sufficiently used for heat dissipation.

It can be seen from FIG. 7 that, the airflow outside the base plate 131 of the heat-dissipating module 130 can pass through the gaps among the fins 132 to flow over the central portion of the base plate 131, thereby dissipating the heat accumulated in the central portion of the base plate 131.

Since the base plate 131 of the present invention is made of sheet metal by pressing rather than by aluminum extrusion, the base plate 131 of a flat sheet metal can be pressed and bent to form the fins 132 thereon, thereby obtaining a three-dimensional heat-dissipating module 130 with reduced working hours and production cost.

It can be seen from FIGS. 4 and 5 that, in the heat-dissipating module 130 of the present invention, since the region among the first bending section 1321, the second bending section 1322, and the base plate 131 is hollowed to form the plurality of airflow channels P, the airflow below the base plate 131 can pass through the airflow channels P along the outside the casing 110 (as indicated by the upward arrows in FIG. 4) to heat-exchange with the fins 132 above the base plate 131. Thus, in addition to the airflow below the base plate 131, the air above the base plate 131 can flow through the fins 132 for heat exchange as shown in FIG. 4. Therefore, the present invention utilizes the airflows below and above the base plate 131, thereby improving the heat-dissipating efficiency greatly.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A lamp, including:

a casing having a hollow chamber;

a light-emitting assembly disposed totally within the hollow chamber; and a heat-dissipating module for dissipating heat generated by the light-emitting assembly, the heat-dissipating module comprising:

a base plate made of sheet metal and connected to the top of the casing, which has a plurality of sides formed on edges of the base plate; and a plurality of fins formed by bending upwardly from the plurality of sides, respectively, each of the fins having a root integrally extend from a corresponding side and at least two bending sections, the at least two bending sections comprising a first bending section extending from the root to form a first bending angle with respect to the base plate and a second bending section extending from one lateral side of the first bending section to form a second bending angle with respect to the first bending section, a region among the bending sections and the base plate being hollowed to form a plurality of airflow channels, wherein a plurality of shrouds are formed in the hollow chamber, the light-emitting assembly includes a circuit board brought into directly thermal contact with a lower surface of the base plate and a plurality of LED arranged on the circuit board to be located within the plurality of shrouds, respectively.

2. A lamp, including:

a casing having a hollow chamber;

a light-emitting assembly disposed totally within the hollow chamber; and a heat-dissipating module for dissipating heat generated by the light-emitting assembly, the heat-dissipating module comprising:

a base plate made of sheet metal and connected to the top of the casing, which has a plurality of sides formed on edges of the base plate; and a plurality of fins formed by bending upwardly from the plurality of sides, respectively, each of the fins having a root integrally extend from a corresponding side and at least two bending sections, the at least two bending sections comprising a first bending section extending from the root to form a first bending angle with respect to the base plate and a second bending section extending from one lateral side of the first bending section to form a second bending angle with respect to the first bending section, a region among the bending sections and the base plate being hollowed to form a plurality of airflow channels, wherein a top surface of the casing is provided with a wire-exiting hole and a plurality of fixing holes, the base plate is brought into directly thermal contact with the top surface of the casing, the light-emitting assembly includes a circuit board disposed on an inner wall surface of hollow chamber opposite to the top surface and a plurality of LEDs arranged on the circuit board, the circuit board is further electrically connected to a wire, one end of the wire away from the circuit board penetrates the wire-exiting hole and is connected to an external power source for obtaining necessary electricity.

3. The lamp according to claim 2, wherein the base plate is provided with a through-hole for allowing one end of the wire penetrating the wire-exiting hole to pass through, the base plate further has a plurality of holes through which screws are fixed into the fixing holes to thereby fix the base plate to the casing.

* * * * *